US006659801B2

(12) United States Patent
Nishio et al.

(10) Patent No.: US 6,659,801 B2
(45) Date of Patent: Dec. 9, 2003

(54) MULTI-CONTACT CONNECTOR PLUG FOR TRANSMITTING AND RECEIVING ELECTRICAL SIGNALS AND SUPPLYING ELECTRICAL POWER

(75) Inventors: Atsushi Nishio, Ibaraki (JP); Katsuhiro Hori, Ibaraki (JP); Fumihiro Hosoya, Ibaraki (JP)

(73) Assignee: Mitsumi Electronic Co., LTD (JP)

( * ) Notice: Subject to any disclaimer, the term of this patent is extended or adjusted under 35 U.S.C. 154(b) by 0 days.

(21) Appl. No.: 10/113,126

(22) Filed: Mar. 29, 2002

(65) Prior Publication Data

US 2002/0142659 A1 Oct. 3, 2002

(30) Foreign Application Priority Data

Mar. 30, 2001 (JP) ..... 2001-097984

(51) Int. Cl.[7] ..... H01R 9/03
(52) U.S. Cl. ..... 439/610; 439/607; 439/905
(58) Field of Search ..... 439/610, 607, 439/609, 905

(56) References Cited

U.S. PATENT DOCUMENTS 5,518,421 A * 5/1996 Davis ..... 439/607
5,683,269 A * 11/1997 Davis et al. ..... 439/607
6,022,239 A * 2/2000 Wright ..... 439/354
6,039,606 A * 3/2000 Chiou ..... 439/607
6,224,422 B1 * 5/2001 Zhu et al. ..... 439/607
6,315,610 B1 * 11/2001 Zheng et al. ..... 439/607
6,364,708 B1 * 4/2002 Chen et al. ..... 439/607

* cited by examiner

*Primary Examiner*—P. Austin Bradley
*Assistant Examiner*—Edwin A. León
(74) *Attorney, Agent, or Firm*—Patents+TMS, P.C.

(57) ABSTRACT

A connector plug includes a metallic shielding cover which is comprised of a first tubular body having a tip side and a second tubular body having a base side, the base side of the second tubular body being partially connected to the tip side of the first tubular body through a continuous connecting part, a plurality of contacts arranged in the shielding cover, and a coupling structure for fixedly coupling the second tubular body to the first tubular body. The structure includes at least one aperture provided in the first tubular body and at least one projection provided in the second tubular body so as to engage with the aperture, and a tip part of the projection is bent for locking the engagement between the aperture and the projection.

15 Claims, 7 Drawing Sheets

MULTI-CONTACT CONNECTOR PLUG FOR TRANSMITTING AND RECEIVING ELECTRICAL SIGNALS AND SUPPLYING ELECTRICAL POWER

BACKGROUND OF THE INVENTION

1. Field of the Invention

This invention relates to a connector plug, and more particularly relates to a multi-contact connector plug for transmitting and receiving electric signals and supplying electrical power by being connected to a mated receptacle in other electronic devices.

2. Description of the Prior Art

FIG. 6 is a perspective view which shows the overall structure of a conventional connector plug used for making connections between electronic devices. FIG. 7 is a longitudinal cross-sectional view which shows a part of a shielding cover of the conventional connector plug.

As shown in FIG. 6, this conventional connector plug 50 is constructed from a shielding cover 52 made of metal, a plurality of contacts arranged inside the shielding cover 52 for making contact with a plurality of contacts provided in a mated receptacle (connector socket), and a contact holding member 51 for holding the contacts inside the shielding cover in the width direction of the connector plug 50.

As shown in FIGS. 6 and 7, the shielding cover 52 includes an outer tubular body 53 and an inner tubular body 58 having a smaller diameter than that of the outer tubular body 53. These outer and inner tubular bodies 53 and 58 are formed by bending a metal plate having a predetermined shape.

In more detail, the outer tubular body 53 is formed into an angular tube shape having four surfaces which include a top surface portion 54, side surface portions 56, 56, and a bottom surface portion 55. The tip part of the bottom surface portion 55 of the outer tubular body 53 is integrally formed with a bottom surface portion 61 of the inner tubular body 58 through a continuous connecting part 62 as described later. Further, the tip part of the top surface portion 54 is formed into a downward-wall 57 by bending the tip part substantially vertically to the other part of the top surface portion 54.

The inner tubular body 58 is also formed into an angular tube shape having four surfaces which include a top surface portion 59, side surface portions 60, 60, and a bottom surface portion 61. As described above, the base end part of the bottom surface portion 61 is integrally formed with the bottom surface portion 55 of the outer tubular body 53 through the continuous connecting part 62 as described above. Further, the base end part of the top surface portion 59 of the inner tubular body 58 is formed into an upward-wall 63 by bending the base end part 58 substantially vertically to the other part of the top surface portion 59.

In the conventional connector plug 50, as shown in FIG. 7, a relative positional relationship between the tip part of the outer tubular body 53 and the base end part of the inner tubular body 58 is maintained by simply engaging the downward-wall 57 of the top surface portion 54 of the outer tubular body 53 with the upward-wall 63 of the top surface portion 59 of the inner tubular body 58.

However, such a structure of the conventional connector plug has a problem in that the tip part of the inner tubular body 58 tends to be displaced upwardly when an external force acts on the connector plug from below in FIG. 7 so that the continuous connecting part 62 is liable to be inwardly deformed, since the relative positional relationship between the tip part of the outer tubular body 53 and the base end part of the inner tubular body 58 is maintained by simply engaging the downward-wall 57 of the top surface portion 54 of the outer tubular body 53 with the upward-wall 63 of the top surface portion 59 of the inner tubular body 58 as described above.

SUMMARY OF THE INVENTION

In view of the problem described above, it is an object of the present invention to provide a connector plug having a simple structure which makes it possible to fixedly couple a first tubular body and a second tubular body so that deformation is hard to occur in a continuous connecting part between these tubular bodies.

In order to achieve the object mentioned above, the present invention is directed to a connector plug which includes a metallic shielding cover including a first tubular body having a tip side and a second tubular body having a base side, the base side of the second tubular body being partially connected to the tip side of the first tubular body through a continuous connecting part; a plurality of contacts arranged in the shielding cover; and means for fixedly coupling the second tubular body to the first tubular body, the coupling means including at least one aperture provided in one of the first and second tubular bodies, at least one projection provided in the other tubular body so as to engage with the aperture, and means for locking the engagement between the aperture and the projection.

In the connector plug of the present invention described above, it is preferred that the at least one aperture is provided in the tip side of the first tubular body and the at least one projection is provided in the base side of the second tubular body.

Further, it is also preferred that the at least one projection has a tip part which extends through the aperture, in which the locking means is provided by bending the tip part of the projection.

Further, in the present invention, it is also preferred that the first tubular body is integrally formed with the second tubular body through the continuous connecting part, and the coupling means is provided on substantially the opposite side of the continuous connecting part.

Furthermore, it is also preferred that the at least one projection is integrally formed with the second tubular body.

Moreover, it is also preferred that the second tubular body is formed by folding a metallic plate member into a predetermined angular tube shape such that opposite edges thereof are in abutment with each other to form a joint.

Preferably, the joint of the second tubular body has a protruding engaging part at the base side thereof, and the at least one projection includes two projections provided on the engaging part in a spaced manner, and the at least one aperture includes two apertures which engage with the two projections, respectively.

Further, in the present invention, it is also preferred that the coupling means further includes positioning means which is used when the projections are engaged with the apertures.

Preferably, the positioning means includes a projection formed on the engaging part of the second tubular body, and an aperture formed on the tip side of the first tubular body to which the projection is fitted.

More preferably, the projection of the positioning means is formed from a pair of pieces integrally formed with the opposite edges in the joint of the second tubular body.

Further, in the present invention, it is also preferred that the first tubular body has a step portion at the tip side thereof, and the at least one aperture is formed in the step portion.

Furthermore, the present invention is also directed to a connector plug which includes a metallic shielding cover which includes a first tubular body having a tip side and a second tubular body having a base side, the base side of the second tubular body being partially connected to the tip side of the first tubular body through a continuous connecting part; a plurality of contacts arranged in the shielding cover; and means for fixedly coupling the second tubular body to the first tubular body, the coupling means providing an undisplaceable firm locking between the tip side of the first tubular body and the base side of the second tubular body at a location substantially opposite to the location of the continuous connecting part.

Preferably, the coupling means includes at least one aperture provided in one of the first and second tubular bodies and at least one projection provided in the other tubular body, in which the undisplaceable firm locking is provided by the engagement between the projection and the aperture.

More preferably, the coupling means further includes means for locking the engagement between the aperture and the projection.

Further, in the present invention, it is also preferred that the projection includes a tip part which extends through the aperture, in which the locking means is provided by bending the tip part of the projection.

As has been described, according to the connector plug of the present invention, the connector plug has a simple structure which makes it possible to fixedly couple the first tubular body and the second tubular body so that deformation is hard to occur in the continuous connecting part between these tubular bodies.

These and other objects, structures and advantages of the present invention will be apparent from the following description of the preferred embodiment when it is considered taken in conjunction with the appended drawings.

DETAILED DESCRIPTION OF THE INVENTION

Hereinbelow, a preferred embodiment of the present invention will be described in detail with reference to the accompanying drawings.

Figure 1:
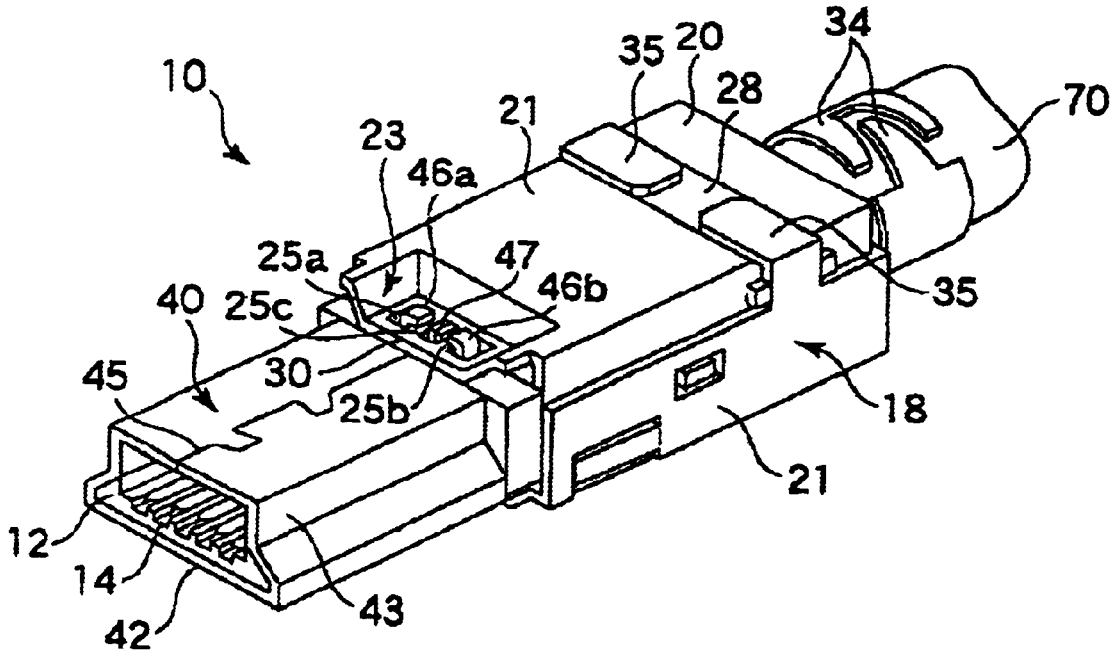
FIG. 1 is a perspective view which shows the overall structure of the connector plug of the present invention.
Figure 2:
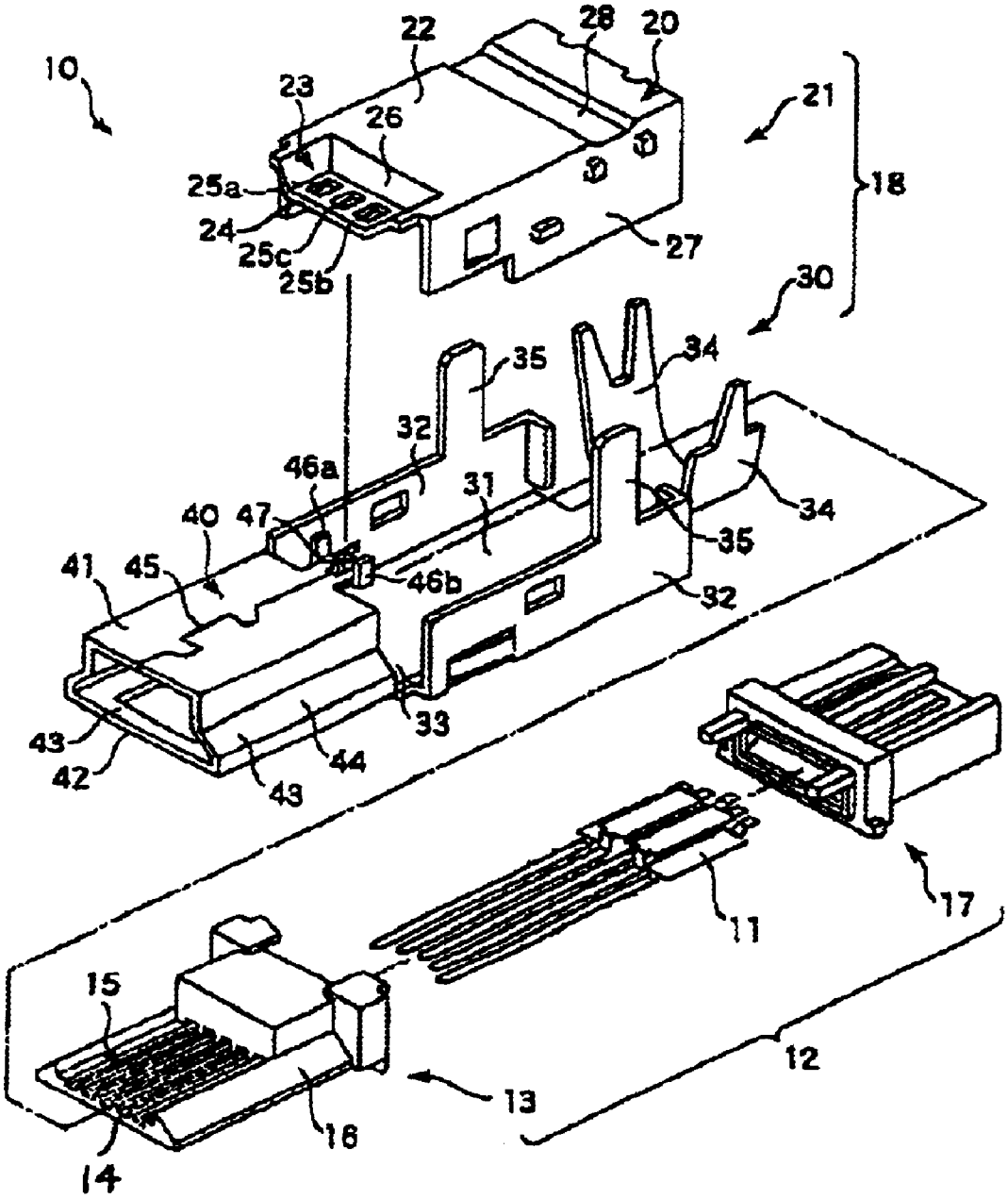
FIG. 2 is an exploded perspective view which shows the structure of the connector plug of the present invention.
Figure 3:
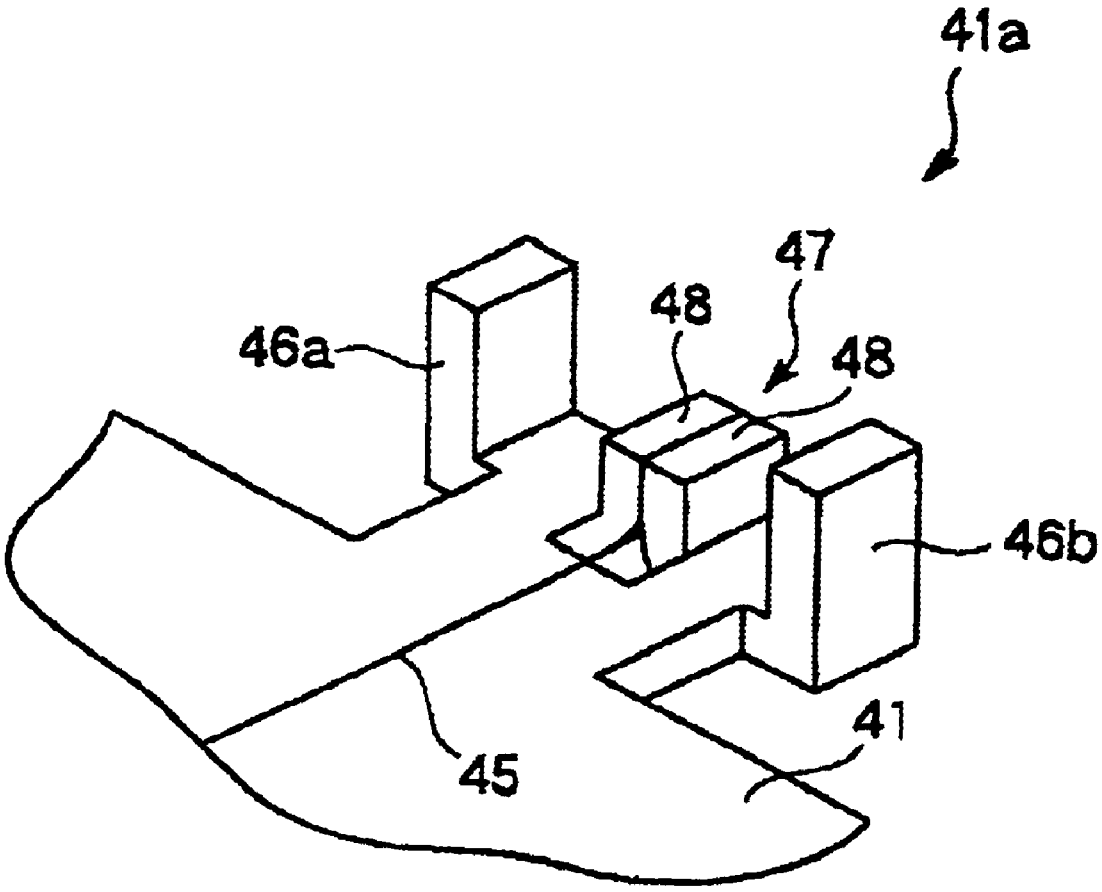
FIG. 3 is an enlarged view which shows a base end part of the second tubular body shown in FIG. 2.
Figure 4:
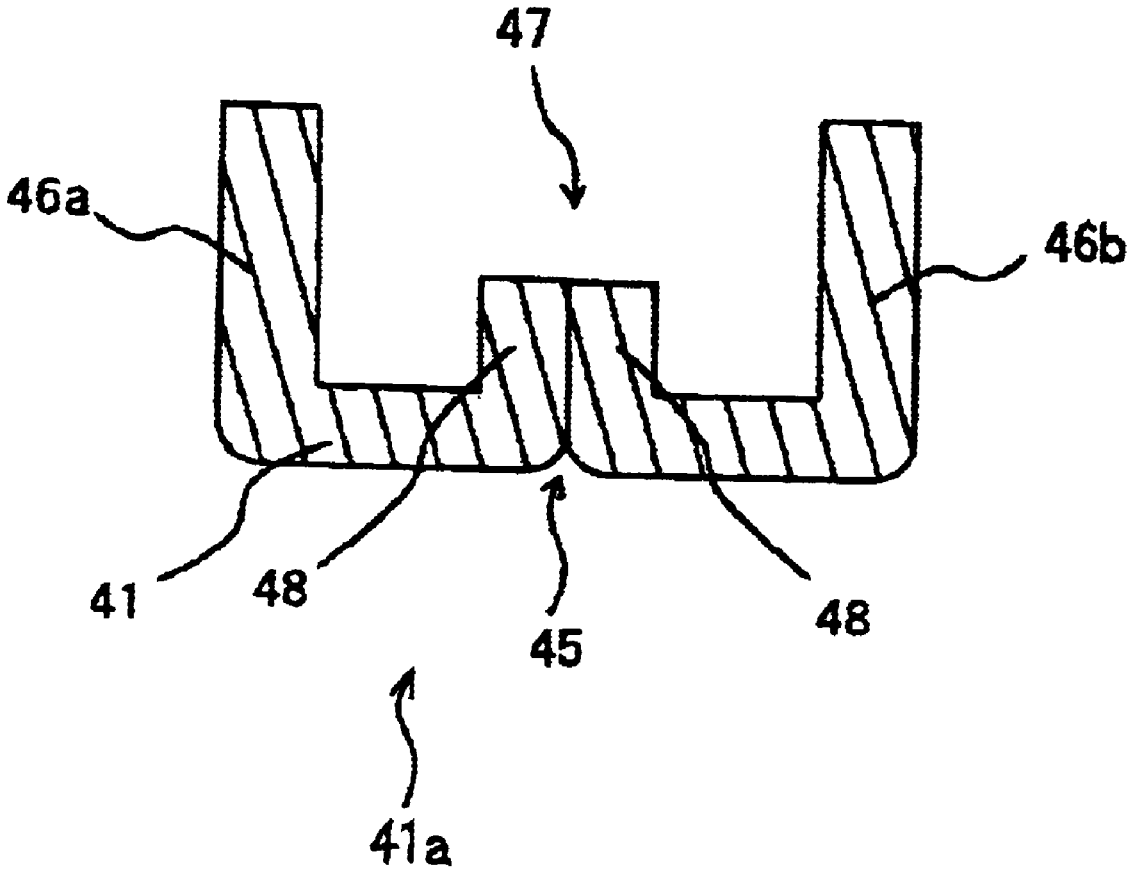
FIG. 4 is a cross-sectional view of the base end part of the second tubular body shown in FIG. 2.
Figure 5:
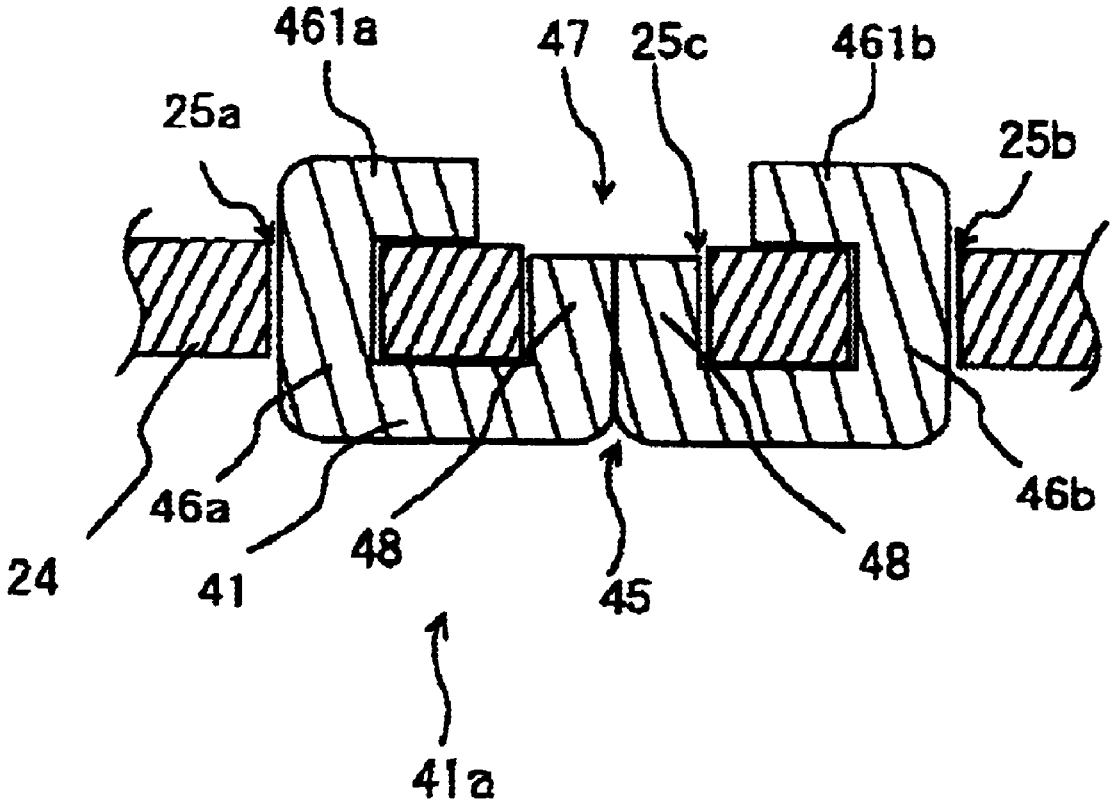
FIG. 5 is a cross-sectional view which shows the state of the engagement between the tip part of the first tubular body and the base end part of the second tubular body shown in FIG. 1.
Figure 6:
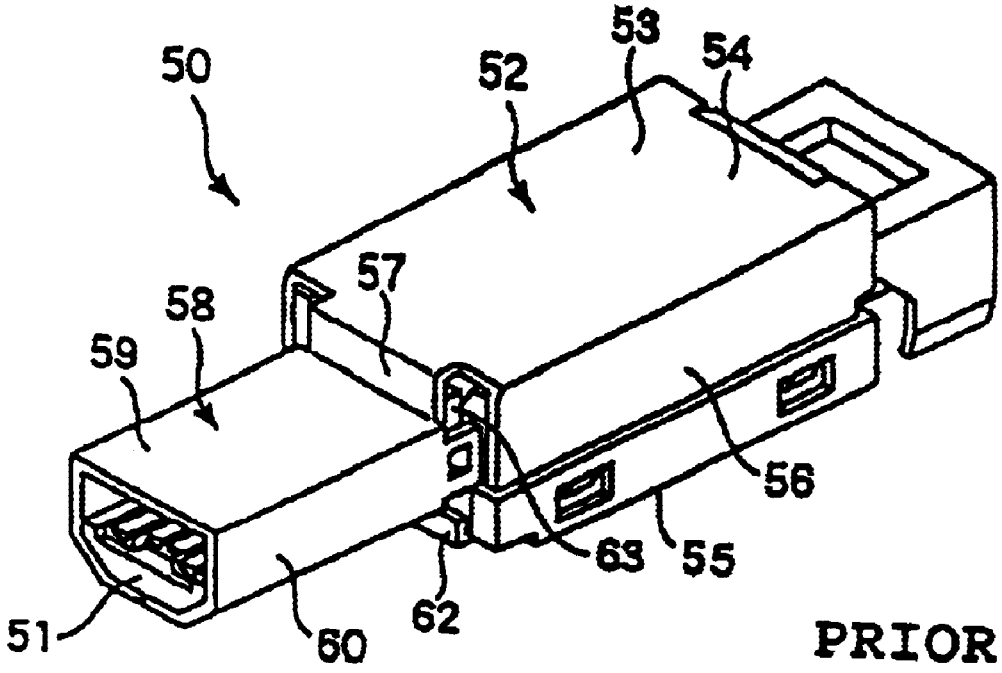
PRIOR ART FIG. 6
FIG. 6 is a perspective view of the conventional connector plug.
Figure 7:
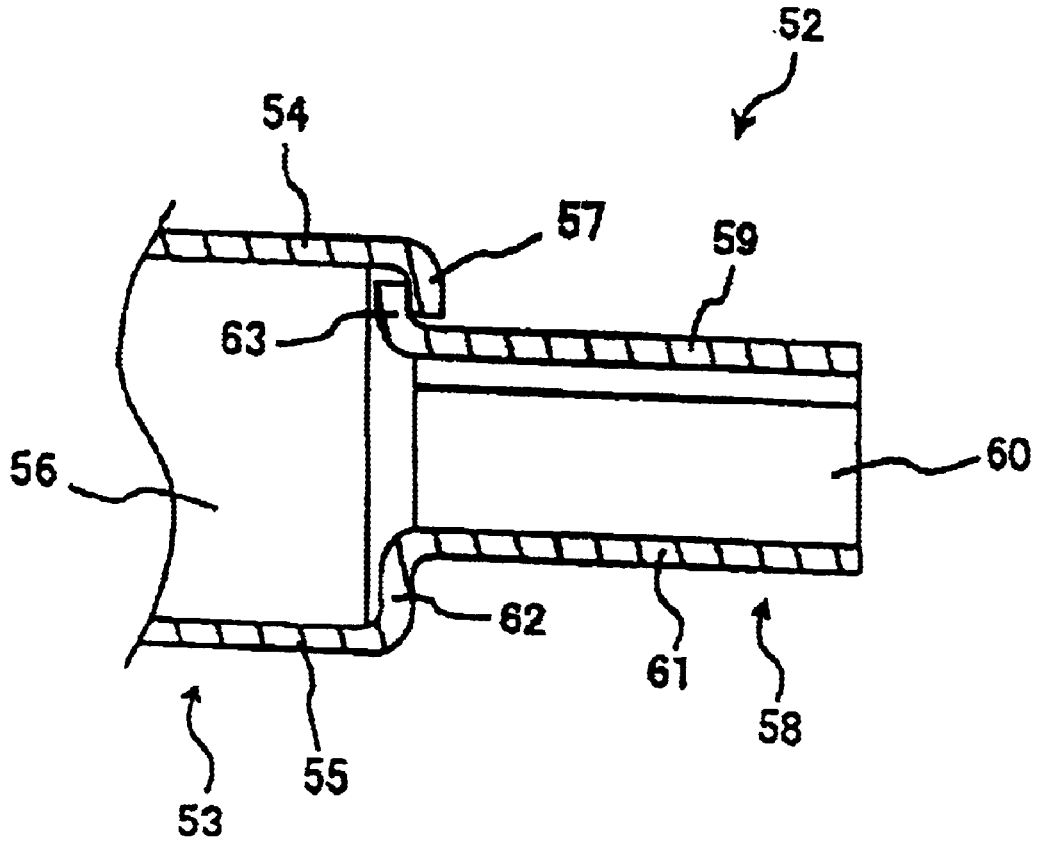
PRIOR ART FIG. 7
FIG. 7 is a longitudinal cross-sectional view of a front portion of a shielding cover of the conventional connector plug.

FIG. 1 is a perspective view which shows the overall structure of a connector plug according to the present invention; FIG. 2 is an exploded perspective view which shows the structure of the connector plug; FIG. 3 is an enlarged view which shows a base end part of the second tubular body shown in FIG. 2; FIG. 4 is a cross-sectional view of the base end part of the second tubular body shown in FIG. 2; and FIG. 5 is a cross-sectional view which shows the state of the engagement between the tip part of the first tubular body and the base end part of the second tubular body shown in FIG. 1.

The connector plug 10 according to the present invention is used with a mated receptacle (not shown in the drawings) to form a connector such as a USB connector.

As shown in FIGS. 1 and 2, the connector plug 10 is roughly constructed from a shielding cover 18 made of metal which includes a first tubular body 20 and a second tubular body 40, a plurality of contacts (terminals) 11 arranged inside the shielding cover 18 for making contact with a plurality of contacts provided in a mated receptacle (connector socket), and a contact holding member 12 for holding the contacts 11 inside the shielding cover 18 in the width direction of the connector plug 10.

The contacts 11 are formed from elongated metal strips. As shown in FIGS. 1 and 2, the contacts 11 are arranged side by side in the width direction of the connector plug 10.

Further, as shown in FIG. 2, the contact holding member 12 is constructed from two members which include a front member 13 and a rear member 17. Each of the front member 13 and the rear member 17 is made of an insulating material, for example, a resin such as polystyrene and the like.

In a top surface 15 of the front member 13 of the contact holding member 12, a plurality of contact holding grooves 14 are formed. The contacts 11 are held by the contact holding grooves 14, respectively, so that the contacts 11 are arranged side by side in the width direction of the connector plug 10 so as not to make contact with each other.

Further, the left and right sides of the top surface 15 of the front member 13 are formed into fitting portions each having a downwardly inclined surface 16. The front member 13 having the above structure is mounted in the second tubular body 40 having spaces for receiving the fitting portions. Specifically, each of the fitting portion receiving spaces is defined by an inclined surface 44 corresponding to the inclined surface 16 of the fitting portions of the front member 13 as described later, and the front member 13 having the above configuration is mounted in the second tubular body 40 in a state that the inclined surfaces 16 of the front member 13 are in abutment with the corresponding inclined surfaces of the fitting portions of the second tubular body 40, respectively.

The base end portions of the contacts 11 are inserted into the rear member 17, and lead wires of a cable 70 are connected to the base end portions of the contacts 11.

As shown in FIGS. 1 and 2, the shielding cover 18 is comprised of the first tubular body 20 and the second tubular body 40. The first tubular body 20 is positioned on the base side (rear side) of the connector plug 10 and the second tubular body 40 is positioned on the tip side (front side) of the connector plug 10. The second tubular body 40 functions as a connecting part to the mated receptacle.

Both the first tubular body 20 and the second tubular body 40 are formed from metal plates (e.g., stainless steel, copper, aluminum) so that they have a function of shielding electromagnetic waves.

In the case of the embodiment of the present invention, the first tubular body 20 is formed to have larger dimensions in width and/or thickness as compared with the dimensions of the second tubular body 40.

In more details, as shown in FIGS. 1 and 2, the first tubular body 20 is composed from two members which include an upper member 21 and a lower member 30.

The upper member 21 includes a top surface portion 22 and a pair of side surface portions 27, 27 which are positioned on the left and right sides of the top surface portion 22, respectively, so as to be vertical to the top surface portion 22.

Further, the lower member 30 includes a bottom surface portion 31 and a pair of side surface portions 32, 32 which are positioned on the left and right sides of the bottom surface portion 31, respectively, so as to be vertical to the bottom surface portion 31. Further, at the base side of the lower member 30, a cable holding portion 34 for holding and fixing the cable 70 is integrally formed. The holding portion 34 is formed to have a pair of band-shaped portions. As shown in FIG. 1, the band-shaped portions are bent so as to wrap around the outer periphery of the cable 70, thereby holding and fixing the cable 70.

By combining such upper member 21 and the lower member 30, the first tubular body 20 is formed into an angular tube shape shown in FIG. 1 having substantially quadrangular cross section.

Further, the bottom surface portion 31 of the lower member 30 and a bottom surface portion 42 of the second tubular body 40 are integrally formed through a continuous connecting part 33. Accordingly, the lower member 30 of the first tubular body 20 and the second tubular body 40 are formed by bending a metal plate which has been processed so as to have a predetermined shape by a punching process or the like.

As shown in FIG. 2, a groove 28 is formed in the base side of the top surface portion 22 of the upper member 21 along the width direction of the first tubular body 20. The groove 28 has a depth roughly corresponding to the thickness of the metal plate.

Further, securing strips 35, 35 are provided in the lower member 30. The securing strips 35, 35 are integrally formed with the side surface portions 32, 32, respectively. As shown in FIG. 1, the upper member 21 and the lower member 30 are fixed by bending both the securing strips 35, 35 at right angles such that the tip parts of the securing strips are fitted in the groove 28, respectively.

A step portion 23 is provided in the tip side of the top surface portion 22 of the upper member 21. The step portion 23 is formed by deforming a roughly central portion along the width direction of the top surface portion 22 toward the inside of the first tubular body 20, that is, toward the bottom side in FIG. 1 so as to form a concave portion.

The step portion 23 is defined by a bottom surface 24 which is substantially parallel to the top surface portion 22 and inclined walls 26 positioned between the bottom surface 24 and the top surface portion 22. Further, in the bottom surface 24, there are formed three apertures (through-holes) 25*a*, 25*b*, and 25*c* which are arranged in a row. Engaging projections 46*a*, 46*b* and a positioning projection 47 provided in the base end portion of the second tubular body 40 are inserted into these apertures 25*a* to 25*c*, respectively, as described later.

As shown in FIGS. 1 and 2, the second tubular body 40 is formed into a substantially angular tube shape which includes a top surface portion 41, a bottom surface portion 42 and a pair of side surface portions 43, 43. This second tubular body 40 is also formed by folding a metal plate having predetermined shape and size into the above configuration.

As described above in the above, each of the side surface portions 43, 43 is provided with the inclined surface 44 in its lower portion which defines the fitting portion receiving space, respectively. The inclined surfaces 44 are in abutment with the corresponding inclined surfaces 16 of the fitting portions of the front member 13 of the contact holding member 12, respectively, when the contact holding member 12 is inserted into the second tubular body 40 upon assembling the connector plug 10. This prevents the contact holding member 12 from being moved upwardly or downwardly with respect to the second tubular body 40.

Further, as shown in FIGS. 1 and 2, the top surface portion 41 of the second tubular body 40 includes a joint 45 in substantially the center of the width direction of the top surface portion 41. The joint 45 is formed by folding the metallic plate member into the angular tube shape described above such that opposite edges thereof are in abutment with each other in the top surface portion 41. Further, as shown in FIG. 1, one of the opposite edges which form the joint 45 is formed with notches and the other edge is formed with protruding portions fitted into the notches for making reliable joining of the edges.

Further, the top surface portion 41 of the second tubular body 40 has a protruding engaging part 41*a* at the base end thereof. On the engaging part 41*a*, there are provided the two engaging projections 46*a*, 46*b* which are arranged in a space manner and the positioning projection 47 which is arranged between the engaging projections 46*a*, 46*b*.

In more details, as shown in FIGS. 3 and 4, these engaging projections 46*a*, 46*b* are formed by bending projections respectively provided in the opposite edges of the engaging part 41*a* vertically and upwardly with respect to the top surface thereof. As shown in the drawings, these engaging projections 46*a* and 46*b* are arranged in a symmetrical manner with respect to the abutting edges (the joint 45) in the engaging part 41*a*.

First, these engaging projections 46*a* and 46*b* are inserted into the corresponding apertures 25*a*, 25*b* formed in the step portion 23 of the upper member 21 of the first tubular body 20. As a result, the relative positional relationship between the second tubular body 40 and the upper member 21 in the front and rear directions as well as the left and right directions is determined.

Next, as shown in FIG. 5, the tip parts of the engaging projections 46*a* and 46*b* which have passed through the apertures 25*a*, 25*b*, that is the tip parts of the engaging projections 46*a* and 46*b* that extend through the apertures 25*a*, 25*b*, are bent against the upper surface of the bottom surface portion 24 of the step portion 23, respectively. The tip parts of the engaging projections 46*a* and 46*b* are bent at substantially right angles to form locking portions 461*a* and 461*b* for locking the engaging part 41*a* of the second tubular body to the bottom surface 24 of the step portion 23 of the upper member 21.

By this locking made by the locking portions 461*a*, 461*b*, the relative positional relationship between the second tubular body 40 and the upper member 21 in the up and down directions is also determined in addition to the positional relationship in the front and rear directions and the up and down directions.

As described above, in the connector plug of this embodiment, the base end part of the second tubular body 40 is positioned with respect to and fixedly coupled to the tip part of the first tubular body 20 by engaging the engaging projections 46*a,* 46*b* with the apertures 25*a,* 25*b* (and periphery thereof).

Further, as described above, in this embodiment, the second tubular body 40 is fixedly coupled to the first tubular body 20 reliably by means of the simple structure in which the engaging projections 46*a,* 46*b* of the second tubular body 40 are inserted into the apertures 25*a,* 25*b,* respectively, and then the tip parts of the engaging projections 46*a,* 46*b* are bent or deformed thereby locking the engaging projections 46*a,* 46*b* with the apertures 25*a,* 25*b.* As a result, even if an external force such as bending stress is exerted to the second tubular body 40, deformation is hard to occur at the continuous connecting part 33 and its periphery.

In particular, since the two engaging projections 46*a,* 46*b* are respectively inserted into the difference apertures 25*a,* 25*b,* and then locked therewith, the second tubular body 40 can be fixedly coupled to the first tubular body 20 with better balance.

Further, since the engagement between the engaging projections 46*a,* 46*b* and the apertures 25*a,* 25*b* is carried out at the opposite side of the continuous connecting part 33, it is possible to effectively prevent deformation of the continuous connecting part 33.

As described above, in this embodiment, the engaging projections 46*a,* 46*b* are integrally formed with the second tubular body 40. However, the present invention is not limited to such structure. It is also possible to form the engaging projections 46*a,* 46*b* from a separate member from the second tubular body 40. Further, the number, shape and projecting directions of the engaging projections are also not limited to those shown in the drawings.

As shown in FIGS. 3 to 5, the positioning projection 47 provided between the engaging projections 46*a,* 46*b* is formed from two pieces 48, 48 which are abutted with each other through the joint 45. Each of the pieces 48, 48 is formed by bending a projection integrally formed in the end portion of each edge of the metal plate vertically and upwardly with respect to the top surface portion 41.

This positioning projection 47 functions as a positioning means for positioning the second tubular body 40 to the first tubular body 20 when inserting the engaging projections 46*a,* 46*b* into the apertures 25*a,* 25*b.*

Specifically, the positioning projection 47 is inserted into the corresponding aperture 25*c* of the step portion 23 of the first tubular body 20 and engaged therewith when the engaging projections 46*a,* 46*b* are inserted into the apertures 25*a,* 25*b.* Due to the engagement of the positioning projection 47 with the aperture 25*c,* it is possible to prevent the base end part of the second tubular body 40 and the tip part of the first tubular body 20 from being displaced relatively when the engaging projections 46*a,* 46*b* are bent or deformed.

As described above, in this embodiment, the positioning projection 47 is formed from the two pieces 48, 48 which are abutted with each other through the joint 45, and thus formed positioning projection 47, that is the abutted two pieces 48, 48 is inserted into the aperture 25*c.* Therefore, even if an external force acting on the direction that pulls apart the abutted two pieces 48, 48 is applied to the connector plug 10, the pieces 48, 48 are constrained by the inner peripheral surface of the aperture 25*c,* so that the base end portion of the joint 45 is not opened in the width direction of the connector plug 10.

Further, as shown in FIG. 5, the locking portions 461*a,* 461*b* are in a state protruding from the apertures 25*a*, 25*b* when the connector plug 10 is assembled. However, since they are positioned inside the step portion 23, they will not cause any hindrance.

Further, it should be noted that when the connector plug 10 described above is actually used, the first tubular body 20 of the shielding cover is covered with a resin cover or the like (not shown in the drawings), and only the second tubular body 40 is used as an insertion section (connecting part) to the mated receptacle.

As described above, the connector plug according to the present invention has a simple structure which makes it possible to fixedly couple the first tubular body and the second tubular body so that deformation is hard to occur in the continuous connecting part between these tubular bodies.

Further, since the two engaging projections are provided, the first tubular body and the second tubular body can be fixedly coupled with better balance.

Furthermore, since the second tubular body can be fixedly coupled to the first tubular body only by inserting the engaging projections into the corresponding apertures and then bending the tip parts thereof, the assembly process is extremely simple.

Moreover, since the first and second tubular bodies are partially connected to each other and the engaging projections are integrally formed with the second tubular body, it is possible to suppress increases in the number of components.

Finally, it is to be understood that the present invention is not limited to the embodiment described above, and many changes or additions may be made without departing from the scope of the present invention which is determined by the following claims.

What is claimed is:

1. A connector plug, comprising:

a metallic shielding cover which includes a first tubular body having a tip side and a second tubular body having a base side, the base side of the second tubular body being partially connected to the tip side of the first tubular body through a continuous connecting part;

a plurality of contacts arranged in the shielding cover; and means for fixedly coupling the second tubular body to the first tubular body so that deformation is discouraged from occurring in the continuous connecting part between these tubular bodies, the coupling means including at least one aperture provided in one of the first and second tubular bodies, at least one projection provided in the other tubular body so as to engage with the aperture, and means for locking the engagement between the aperture and the projection wherein the at least one projection has a tip part which extends through and out of the aperture wherein the means for locking is provided by bending or deforming the tip part of the projection from the outside of the metallic shielding cover.

2. The connector plug as claimed in claim 1, wherein the first tubular body is integrally formed with the second tubular body through the continuous connecting part, and the coupling means is provided on substantially the opposite side of the continuous connecting part.

3. The connector plug as claimed in claim 1, wherein the at least one aperture is provided in the tip side of the first tubular body and the at least one projection is provided in the base side of the second tubular body.

4. The connector plug as claimed in claim 3, wherein the at least one projection is integrally formed with the second tubular body.

5. The connector plug as claimed in claim 4, wherein the second tubular body is formed by folding a metallic plate member into a predetermined angular tube shape such that opposite edges thereof are in abutment with each other to form a joint.

6. The connector plug as claimed in claim 5, wherein the joint of the second tubular body has a protruding engaging part at the base side thereof, and the at least one projection includes two projections provided on the engaging part in a spaced manner, and the at least one aperture includes two apertures which engage with the two projections, respectively.

7. The connector plug as claimed in claim 6, wherein the coupling means further includes positioning means which is used when the projections are engaged with the apertures.

8. The connector plug as claimed in claim 7, wherein the positioning means includes a projection formed on the engaging part of the second tubular body, and an aperture formed on the tip side of the first tubular body to which the projection is fitted.

9. The connector plug as claimed in claim 8, wherein the projection of the positioning means is formed from a pair of pieces integrally formed with the opposite edges in the joint of the second tubular body.

10. The connector plug as claimed in claim 1, wherein the first tubular body has a step portion at the tip side thereof, and the at least one aperture is formed in the step portion.

11. A connector plug, comprising:

a metallic shielding cover which includes a first tubular body having a tip side and a second tubular body having a base side, the base side of the second tubular body being partially connected to the tip side of the first tubular body through a continuous connecting part;

a plurality of contacts arranged in the shielding cover; and means for fixedly coupling the second tubular body to the first tubular body so that deformation is discouraged from occurring in the continuous connecting part between these tubular bodies, the coupling means providing an undisplaceable firm locking between the tip side of the first tubular body and the base side of the second tubular body at a location substantially opposite to the location of the continuous connecting part, wherein the coupling means includes at least one aperture provided in one of the first and second tubular bodies and at least one projection provided in the other tubular body and a means for locking the engagement between the aperture and the projection, in which the projection includes a tip part which extends through and out of the aperture, in which the means for locking is provided by bending or deforming the tip part of the projection from the outside of the metallic shielding cover.

12. A connector plug comprising:

a metallic shielding cover which includes a first tubular body having a tip side and a second tubular body having a base side, the base side of the second tubular body being partially connected to the tip side of the first tubular body through a continuous connecting part;

a plurality of contacts arranged in the shielding cover;

means for fixedly coupling the second tubular body to the first tubular body, the coupling means including at least one aperture provided in one of the first and second tubular bodies, at least one projection provided in the other tubular body so as to engage with the aperture, and means for locking the engagement between the aperture and the projection wherein the at least one aperture is provided in the tip side of the first tubular body and the at least one projection is provided in the base side of the second tubular body wherein the at least one projection is integrally formed with the second tubular body and further wherein the second tubular body formed by folding a metallic plate member into a predetermined angular tube shape such that opposite edges thereof are in abutment with each other to form a joint wherein the joint of the second tubular body has a protruding engaging part at the base side thereof, and the at least one projection includes two projections provided on the engaging part in a spaced manner, and the at least one aperture includes two apertures which engage with the two projections, respectively.

13. The connector plug of claim 12 wherein the coupling means further includes positioning means which is used when the projections are engaged with the apertures.

14. The connector plug of claim 13 wherein the positioning means includes a projection formed on the engaging part of the second tubular body, and an aperture formed on the tip side of the first tubular body to which the projection is fitted.

15. The connector plug of claim 14 wherein the projection of the positioning means is formed from a pair of pieces integrally formed with the opposite edges in the joint of the second tubular body.

* * * * *